United States Patent [19]

Kuehnle

[11] 4,240,125

[45] Dec. 16, 1980

[54] CORONA GENERATING ELEMENT

[75] Inventor: Manfred R. Kuehnle, Lexington, Mass.

[73] Assignee: Coulter Systems Corp., Bedford, Mass.

[21] Appl. No.: 28,641

[22] Filed: Apr. 11, 1979

Related U.S. Application Data

[63] Continuation-in-part of Ser. No. 898,730, Apr. 24, 1978, abandoned.

[51] Int. Cl.[3] ..... H01T 19/04

[52] U.S. Cl. ..... 361/230; 55/152

[58] Field of Search ..... 361/229, 230; 55/152; 313/351

[56] References Cited

U.S. PATENT DOCUMENTS

| | | | |
|---|---|---|---|
| 3,485,011 | 12/1969 | Archer et al. | 55/152 X |
| 3,819,985 | 6/1974 | Dusevoir | 361/230 |
| 3,959,690 | 5/1976 | Leibrecht | 361/230 |

*Primary Examiner*—Harry E. Moose, Jr.

*Attorney, Agent, or Firm*—Silverman, Cass & Singer, Ltd.

[57] ABSTRACT

A corona generating element in the form of a strand of metal wire having thin portions along its length at closely and regularly spaced intervals. When a source of high voltage is connected to the wire, a corona of high intensity is generated along the edges of each thin portion. The corona generating element is particularly useful in applying a uniform electrostatic charge of negative polarity to the surface of a photoconductive member.

30 Claims, 2 Drawing Figures

CORONA GENERATING ELEMENT

Reference is made to U.S. application Ser. No. 898,730 filed Apr. 24, 1978, now abandoned, of which this application is a continuation-in-part.

BACKGROUND OF THE INVENTION

This invention relates to a corona generating element and more particularly to a corona generating element for use in electrophotography.

Corona generating elements are used in electrophotography to apply a uniform electrostatic charge to the surface of a photoconductive member. The charge applied may be either positive or negative depending on the nature of the photoconductive member. If the charge applied to the surface of the member is not uniform, the electrostatic image formed on the surface on exposure to a light pattern will not correspond exactly to the light pattern but will result partly from variations in the unformity of the applied charge.

In U.S. Pat. No. 4,025,339 to M. R. Kuehnle, there is described a photoconductive member of extremely high sensitivity that is capable of reproducing or creating high resolution images, that is, each point on the surface of the member is capable of selectively discharging in accordance with the intensity of incident light so that an almost infinite scale of grey tones can be reproduced on the resultant image. The photoconductive member accepts a charge of negative polarity. In order to make full use of the exceptional features of this photoconductive member, it is necessary that the charge applied be substantially uniform over its entire surface.

One type of corona generating element that is commonly used in electrophotography is in the form of a strand of fine metal wire of circular cross-section. The diameter of the wire is usually in the order of about 75 microns. The wire is stretched taut between anchoring end pieces and connected to a source of high voltage of sufficient magnitude to ionize the air about the strand. The ions so produced are then attracted to the photoconductive member by any suitable means. Some of the advantages of this type of corona generating element are that it is simple in construction, is easy to fabricate, inexpensive to fabricate, and will produce a substantially uniform corona throughout its length when used in the positive mode. One of the disadvantages of this type of corona generating element is that it will not produce a uniform corona when it is used in the negative mode. More specifically, it has been found that when a strand of metal wire is used to generate a negative corona, the corona so produced will have a tendency to vary in density from point to point along its length. It is believed that this nonuniformity is caused by randomly located and shifting hot spots which develop for one reason or another along the wire and become sources of intense radiation. In order to compensate for these hot spots and to produce a corona along the wire that is substantially uniform, various approaches have been suggested and/or actually put into use. For example, in U.S. Pat. No. 3,958,162 to M. R. Kuehnle, a plurality of metal wire corona generating elements are positioned parallel to and rotated about a central axis and in U.S. Pat. No. 3,978,380 to P. G. Talmage, a single metal wire corona generating element is reciprocated about its longitudinal axis. Examples of other approaches that have been suggested and/or actually put into use to compensate for hot spots in a metal wire corona generating element may be found in U.S. Pat. No. 2,856,533 to J. F. Rosenthal and U.S. Pat. No. 3,233,156 to J. G. Jarres et al.

Another type of corona generating element that is frequently used in electrophotography is in the form of an array of needle- or pin-shaped electrodes conductively connected to each other. When a high voltage source is connected to the electrodes, a corona is generated around the tipe of each electrode. Although this type of corona generating element does not have the problem of randomly located hot spots, it does have other types of problems. One of the main problems is that the electrodes must be spaced a relatively large distance apart to produce a relatively uniform corona at voltages around 6 KV and if one electrode should fail to operate there is a sizeable area over which no corona is generated. Examples of this type of corona generating element may be found in U.S. Pat. No. 3,581,149 to H. Tanaka et al.; U.S. Pat. No. 3,624,392 to A. Kurahashi, etc.; U.S. Pat. No. 3,649,380 to M. Sato et al.; U.S. Pat. No. 3,691,373 to R. G. Compton, etc.; U.S. Pat. No. 3,765,154 to Hardt et al.; and U.S. Pat. No. 3,959,690 to K. Leibrecht.

Examples of other types of corona generating elements used in applications other than electrophotography may be found in U.S. Pat. No. 2,852,093 to R. G. Streuder, U.S. Pat. No. 3,294,971 to J. C. Von De Hade, and U.S. Pat. No. 3,766,382 to H. Lin.

SUMMARY OF THE INVENTION

It is the general purpose of this invention to provide a metal wire type of corona generating element that will produce a substantially uniform corona over its length when it is used in the negative mode.

A corona generating element in accordance with this invention comprises a strand of metal wire having a plurality of identically shaped, thin portions. The thickness of the thin portions is less than the thickness of the other portions of the wire. The thin portions are located along the length of the wire at closely spaced intervals and include razor-sharp edges which function as knife-edge type corona emission surfaces. When a high voltage source is connected to the wire, a high intensity corona is produced at the razor-sharp edges of each thin portion. Since the thin portions are closely spaced along the wire, the net result is a substantially uniform corona (i.e., a continuous series of closely spaced coronas) along the entire length of the wire. Because of the particular configuration of the wire, randomly located and shifting hot spots will not develop along its length when it is used in the negative mode. As a consequence, the corona generating element is particularly useful in applying a uniform negative electrostatic charge to the surface of a photoconductive member. Furthermore, since the intensity of a corona generated by a wire varies inversely with the diameter (i.e., thickness) of the wire to the third power and since the thickness of the thin portions is less than the diameter of the wire, the intensity of the corona produced at the thin portions is much greater than the intensity of the corona that would normally be produced at those locations.

DESCRIPTION OF THE PREFERRED EMBODIMENT

Figure 1:
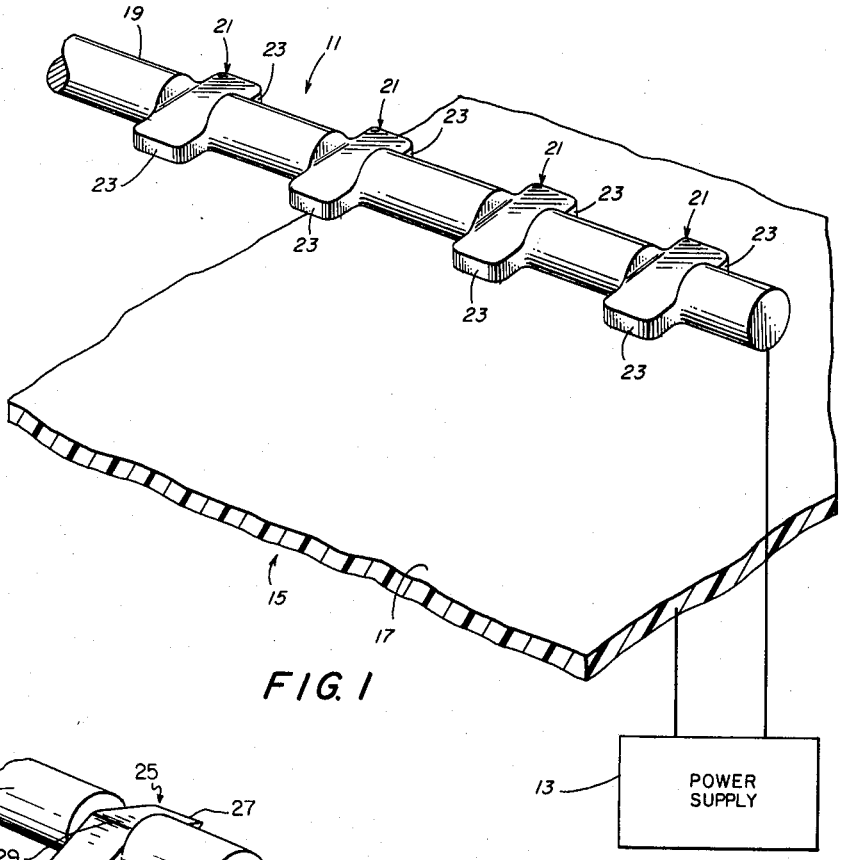
FIG. 1 is a perspective view of a corona generating element constructed in accordance with the invention including a block diagram and FIG. 2 is a fragmentary perspective view of a modified form of the invention.

Referring to the drawing in FIG. 1, there is illustrated a corona generating element identified generally by reference numeral 11. A corona power supply 13 whose output is a negative D.C. voltage of 6 KV is connected to corona generating element 11. A photoconductive member 15 of the type that is charged with a negative voltage is positioned to accept a charge from corona generating element 11 on its upper surface 17.

Corona generating element 11 comprises a strand of wire 19 which may be made of tungsten or any other metal suitable for corona emission. Wire 19 is of circular cross-section and has a series of identical, generally rectangularly shaped, generally rectangularly cross-sectionally shaped, razor thin, flat portions 21. Flat portions 21 are located along the length of wire 19 at closely spaced intervals and are formed such that they lie in a common plane which includes the longitudinal axis of wire 19. The thickness of flat portions 21 is less than the diameter of wire 19. Flat portions 21 contain sides which extend laterally outward beyond the body wire 19 and terminate at side edges 23. These side edges 23 function as knife-edge type corona emission surfaces. Typical dimensions for corona generating element 11 are as follows:

| | |
|---|---|
| Cross-sectional diameter of wire | 75 microns |
| Thickness of flat portions | 25 microns |
| Longitudinal dimension of flat portions (i.e., dimension along longitudinal axis of wire) | 0.5 millimeter |
| Lateral dimension of flat portions | 1 millimeter |
| Distance between centers of successive flat portions | 3 millimeters |

Since the thickness of the flat sections in the exemplary dimensions listed above is one-third the diameter of the wire, the intensity of the corona produced at each flat section is twenty-seven times greater than the corona that would otherwise be produced at that location.

When wire 19 is energized by corona power supply 13, a corona of high intensity is produced along the side edges 23 of each flat portion 21. The net result of the corona generated at each of these locations is a continuous series of high intensity coronas substantially uniformly distributed over the entire length of wire 19.

Figure 2:
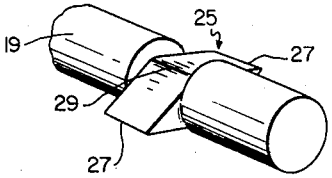

In FIG. 2, there is illustrated a preferred embodiment of the corona generating element 11. In this embodiment, the corona generating element 11 comprises the strand of wire 19, with a series of thin axehead portions 25. Axehead portions 25 are located along the length of wire 19 at closely spaced intervals. Axehead portions 25 are formed to be generally similar to flat portions 21, except that axehead portions 25 have a cross-section normal to the longitudinal axis of the wire 19 that is substantially diamond-shaped and they have razor edges 27, which extend laterally beyond the body of wire 19. These razor edges 27 function as knife-edge type corona emission surfaces.

Axehead portions 25 are formed in such a way that razor edges 27 lie in a common place which includes the longitudinal axis of wire 19. The sloping part 29 of axehead portions 25 which are between razor edges 27 have a thickness less than the diameter of wire 19. Razor edges 27 are thinner than side edges 23 of flat portions 21.

When wire 19 is energized by corona power supply 13, a corona of high intensity is produced along razor edges 27 of each axehead portion 25. The net result of the corona generated at each of these locations is a continuous series of high intensity coronas substantially uniformly distributed over the length of wire 19.

The thin flat portions 21 and thin axehead portions 25 are located along the length of the wire 19 at closely spaced intervals to produce a continuous series of high intensity coronas which are substantially uniformly distributed over the entire length of wire 19. Their intervals may be regular or irregular as long as a continuous series of coronas are substantially uniformly distributed over the entire length of wire 19.

The preferred embodiment of the thin axehead portion 25 has been described as having two razor edges 27 extending beyond the body of wire 19. One razor edge 27 on axehead portion 25 would operate to form the desired corona, but two edges are preferred. Also, if one of the razor edges 27 should break off, the newly formed edge will funcation as a corona generating surface. Furthermore, since the corona is generated at the razor edges 27 of the axehead portions 25 of the wire and since the razor edges 27 are thinner than the other portions of the wire and the side edges 23 of flat portions 21, the intensity of the corona at the razor edges 27 is much larger than the corona that would otherwise be produced. Finally, and most importantly, since the corona is generated along the closely spaced razor edges 27 of the axehead portions 25 and not along the other portions of the wire, the likelihood of randomly located and shifting hot spots being generated when the wire is used in the negative mode is greatly reduced if not totally eliminated.

Corona generating element 11 may be fabricated by taking a length of metal wire of circular cross-section and then forming the thin portions by hammering, stamping, crimping, or any other suitable means known in the art.

The corona generating element can be used by fixing the same between supports or it could be mounted upon suitable brackets to be rotated as taught by U.S. Pat. No. 3,958,162 or reciprocated as taught by U.S. Pat. No. 3,978,380. Added benefits may thus be achieved.

While the invention has been described for particular use in applying an electrostatic charge of negative polarity, it is to be understood that the invention is also useful in applying an electrostatic charge of positive polarity.

Variations can be made in the invention without departing from the spirit or scope as defined in the appended claims.

What it is desired to secure by Letters Patent of the United States is:

1. A corona generating element for use in applying a uniform electrostatic charge to the surface of a photoconductive member comprising a strand of metal wire having a plurality of identical thin portions along its length, the thickness of the thin portions being less than the thickness of the body of the wire, the thin portions being located at closely spaced intervals, each thin portion terminating in at least one edge constituting a corona emission surface, whereby, when a source of high voltage is connected to the corona generating element a corona will be generated along the edge of the thin portions and a substantially uniform corona will be generated along the length of the metal wire.

2. A corona generating element as claimed in claim 1 in which each thin portion includes a pair of edges.

3. A corona generating element as claimed in claim 2 in which the edges of each thin portion are located on opposite sides of the wire.

4. A corona generating element as claimed in claim 3 in which the edge of the thin portions extends outward beyond the body of the wire.

5. A corona generating element as claimed in claim 4 in which the wire is circular in cross-section.

6. A corona generating element as claimed in claim 5 in which the thin portions are disposed in a common plane.

7. A corona generating element as claimed in claim 6 in which the longitudinal axis of the wire lies in the plane in which the thin portions are disposed.

8. A corona generating element as claimed in claim 4 in which the thin portion has a cross-section normal to the longitudinal axis of the wire which is substantially diamond-shaped and has edges which are razor sharp.

9. A corona generating element as claimed in claim 4 in which the thin portion has a cross-section normal to the longitudinal axis of the wire which is substantially rectangularly shaped and has edges which form sides.

10. A corona generating element as claimed in claim 8 or claim 9 in which the thin portions are located at closely and regularly spaced intervals.

11. A corona generating element as claimed in claim 8 or claim 9 in which the edges of the thin portions have rounded corners.

12. A corona generating element as claimed in claim 1 in which the thickness of the thin portions is about one-third the diameter of the wire, whereby the intensity of the corona produced at each thin section is about twenty-seven times the intensity of the corona that would otherwise be produced at that location.

13. A corona generating element as claimed in claim 1 in which the thickness of the thin portions is about 25 microns and the diameter of the wire is about 75 microns.

14. A corona generating element as claimed in claim 13 in which the wire is made of tungsten.

15. A corona generating element as claimed in claim 14 in which the distance between centers of successive thin portions is about 3 millimeters.

16. Apparatus for applying a uniform negative electrostatic charge to the surface of a photoconductive member comprising a power source whose output is a negative D.C. voltage and a corona generating element connected to the output of the power source, the corona generating element comprising a strand of metal wire having thin portions along its length at closely spaced intervals, the thickness of the thin portions being less than the thickness of the body of the wire, the thin portions terminating in outer edges, the outer edges constituting knife edge type corona emission surfaces.

17. A corona generating element for use in applying a uniform electrostatic charge to the surface of a photoconductive member comprising a strand of metal wire having a plurality of identical razor-thin flat portions along its length, the thickness of the flat sections being less than the thickness of the other portions of the wire, the flat portions being located at closely and regularly spaced intervals, the flat portions having sides that terminate in side edges, the side edges constituting corona emission surfaces, whereby, when a source of high voltage is connected to the corona generating element, a corona will be generated along the side edges of each flat portion.

18. The corona generating element of claim 17 and wherein the thickness of the flat portions is about one-third the diameter of the wire, whereby the intensity of the corona produced at each flat section is about twenty-seven times the intensity of the corona that would otherwise be produced at that location.

19. The corona generating element of claim 17 and wherein each flat portion contains a pair of side edges.

20. The corona generating element of claim 19 and wherein the side edges of each flat portion are located on opposite sides of the wire.

21. The corona generating element of claim 20 and wherein the sides of the flat portions extend outward beyond the surface of the wire.

22. The corona generating element of claim 21 and wherein the flat portions are generally rectangularly shaped.

23. The corona generating element of claim 22 and wherein the corners of the flat portions are rounded.

24. The corona generating element of claim 20 and wherein the wire is circular in cross-section.

25. The corona generating element of claim 24 and wherein the flat portions are disposed in a common plane.

26. The corona generating element of claim 25 and wherein the longitudinal axis of the wire lies in the same plane as the plane containing the flat portions.

27. The corona generating element of claim 17 and wherein the thickness of the flat portions is about 25 microns and the diameter of the wire is about 75 microns.

28. The corona generating element of claim 27 and wherein the wire is made of tungsten.

29. The corona generating element of claim 28 and wherein the distance between centers of successive flat sections is about 3 millimeters.

30. Apparatus for applying a uniform negative electrostatic charge to the surface of a photoconductive member comprising power source whose output is a negative D.C. voltage and a corona generating element connected to the output of the power source, the corona generating element comprising a strand of metal wire having razor thin flat portions along its length at closely and regularly spaced intervals, the thickness of the flat portions being less than the thickness of the other portions of the wire, the flat portions having side edges, the side edges constituting knife-edge type corona emission surfaces.

* * * * *